US006577075B2

(12) United States Patent
Romano et al.

(10) Patent No.: US 6,577,075 B2
(45) Date of Patent: Jun. 10, 2003

(54) HIGH INTENSITY DISCHARGE LAMP MAGNETIC/ELECTRONIC BALLAST

(75) Inventors: Shafrir Romano, 20/15 Hatizmoret Street, Rishon-LeZion (IL); Dror Manor, Herzliya (IL); Arkadi Nirenberg, Beer-Sheva (IL)

(73) Assignee: Shafrir Romano, Rishon-Lezion (IL)

( * ) Notice: Subject to any disclaimer, the term of this patent is extended or adjusted under 35 U.S.C. 154(b) by 0 days.

(21) Appl. No.: 09/987,432

(22) Filed: Nov. 14, 2001

(65) Prior Publication Data

US 2002/0089293 A1 Jul. 11, 2002

Related U.S. Application Data

(60) Provisional application No. 60/247,886, filed on Nov. 14, 2000.

(51) Int. Cl.[7] ..... H05B 37/02

(52) U.S. Cl. ..... 315/276; 315/282; 315/283; 315/287; 315/289; 315/291; 315/DIG. 2; 315/DIG. 5

(58) Field of Search ..... 315/289, 218, 315/219, 223, 224, 247, 276, 282, 283, 287, 291, 307, 362, DIG. 2, DIG. 5, DIG. 7

(56) References Cited

U.S. PATENT DOCUMENTS 3,894,265 A * 7/1975 Holmes et al. ..... 315/194
4,501,994 A * 2/1985 Spreadbury ..... 315/307
5,515,261 A * 5/1996 Bogdan ..... 363/89
5,677,602 A * 10/1997 Paul et al. ..... 315/224

* cited by examiner

*Primary Examiner*—Don Wong
*Assistant Examiner*—Thuy Vinh Tran
(74) *Attorney, Agent, or Firm*—Edward Langer; Shiboleth, Yisraeli, Roberts, Zisman & Co.

(57) ABSTRACT

A metal halide magnetic/electronic ballast with a compensation function for adjustment in autotransformer output voltage, which applies the compensation in various steps of voltage, to maintain the power constant. The metal halide ballast provides constant monitoring of the autotransformer input voltage, enabling the level to be stepped by triac switching. The triac switching is controlled by a switching control provided by a microcontroller. Less components are required, making the present invention simpler, less expensive to manufacture and more reliable.

15 Claims, 6 Drawing Sheets

HIGH INTENSITY DISCHARGE LAMP MAGNETIC/ELECTRONIC BALLAST

This application Claims the benefit of Provisional Application No. 60/247,886 filed Nov. 14, 2000.

FIELD OF THE INVENTION

The present invention relates to an integrated magnetic and electronic ballast for metal halide lamps. More particularly, the invention relates to a magnetic/electronic ballast designed to prolong the life of a metal halide lamp.

BACKGROUND OF THE INVENTION

Existing illumination systems for high intensity discharge (HID) lamps, such as metal halide lamps, include conventional systems involving a core and coil arrangement and electronic ballast systems. The conventional systems are provided as an autotransformer and choke arrangement with an igniter and capacitor for power factor correction. The electronic ballasts are typically manufactured by Phillips Corporation, of Holland, and by Aromat Ltd. of Japan.

Metal halide lamps are very expensive and it would be desirable to prolong the lamp life as much as possible. As the line voltage changes or the lamp ages and its impedance characteristics change, therefore the lamp current, voltage and power change too. When the line voltage is increased, the lamp power is high. However, while the lamp provides greater brightness according to the Color Rendering Index (CRI), the result is a shorter lamp life, lamp and/or fixture damage, low color temperature, reduced efficiency, and electrode damage due to high curent. If the line voltage decreases, the lamp power is low, resulting in high color temperature, reduced CRI, low light output, which may damage the lamp, reducing its efficiency, since at low current the lamp fails to warm up. Thus, it is necessary to maintain the power constant.

The existing conventional type electromagnetic illumination systems, although they are very reliable, do not have any control of the current or voltage supply to the metal halide lamp, except for the so-called Constant Wattage Autotransformers (CWA) which provide regulation of about ±12% in relation to ±10% variations of the line voltage, but this is not good enough, and there is no control when the lamp ages.

The existing electronic ballasts do have control of the current and check the changes in current and voltage. In order to compensate for a change in current and lamp voltage, the illumination system maintains the power level constant by a smooth compensation function. However, these electronic ballasts are both more expensive and less reliable, since they have many electronic components that can malfunction. Additionally, the electronic ballasts use MOSFET switching techniques which operate at a high frequency and therefore generate radio frequency interference (RFI) effects. RFI effects are detrimental to the environment and have detrimental effects on other equipment. The electronic ballasts generally do not meet the standards that require a low level of RFI generation for any electrical device.

It would be desirable to provide a ballast for a metal halide lamp that would be economical, reliable, easy to manufacture and would increase lamp life while not generating RFI effects.

SUMMARY OF THE INVENTION

Accordingly, it is a broad object of the present invention to overcome the problems of the prior art and provide a metal halide ballast with improved properties.

In accordance with a preferred embodiment of the present invention there is provided a magnetic/electronic metal halide ballast with a compensation function for adjustment in autotransformer output voltage, which applies the compensation in various steps of voltage, to maintain the power constant. The metal halide ballast of the present invention provides constant monitoring of the autotransformer input voltage, enabling the level to be stepped by triac switching. The triac switching is controlled by a switching control provided by a microcontroller. Less components are required, making the present invention simpler, less expensive to manufacture and more reliable.

Other features and advantages of the invention will become apparent from the following drawings and the description.

BRIEF DESCRIPTION OF THE DRAWINGS

For a better understanding of the invention with regard to the embodiments thereof, reference is made to the accompanying drawings, in which like numerals designate corresponding elements or sections throughout and in which.

DETAILED DESCRIPTION OF A PREFERRED EMBODIMENT

Figure 1:
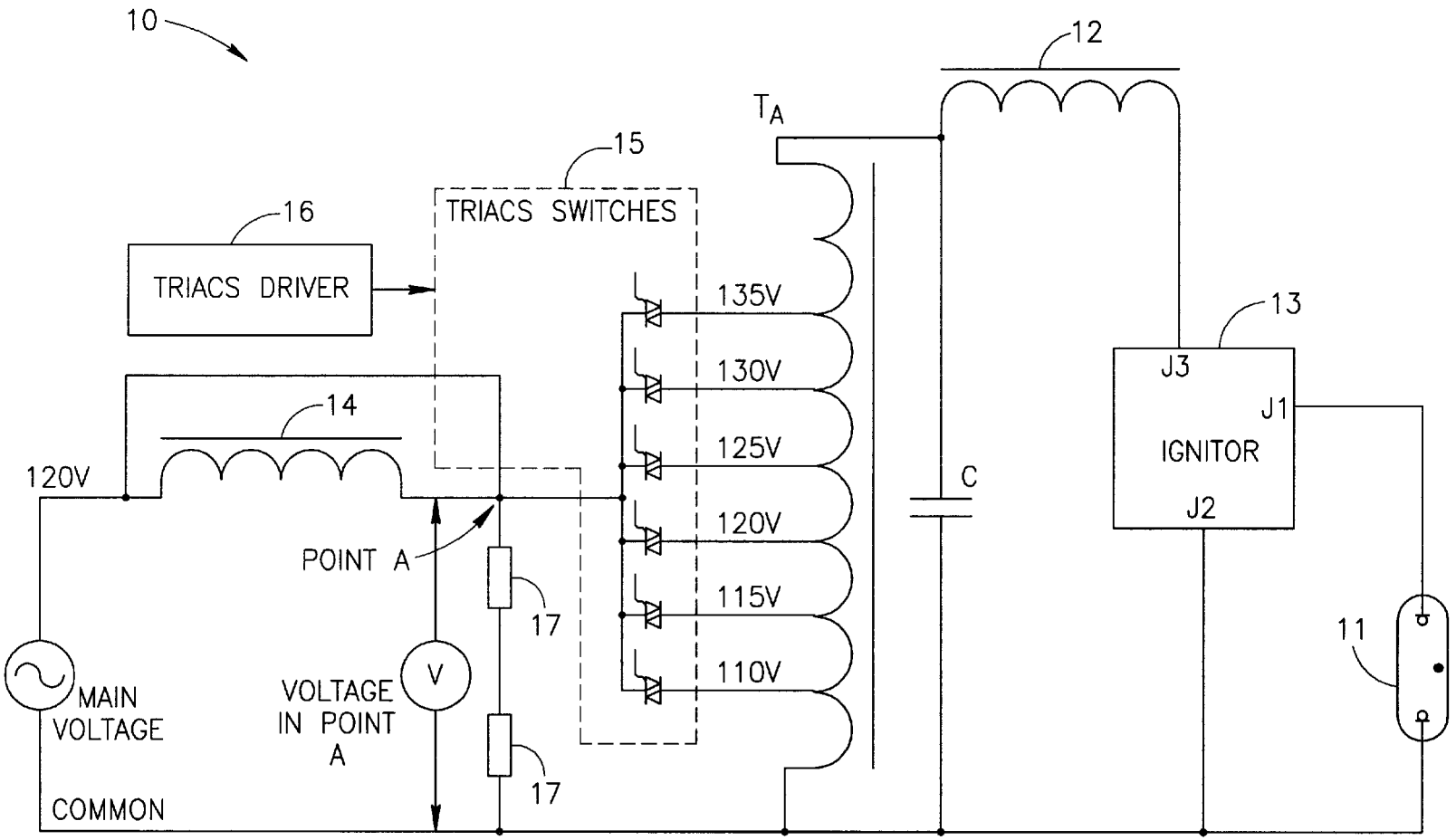
FIG. 1 is an electronic schematic of the magnetic/electronic metal halide ballast of the present invention.
Figure 2A:
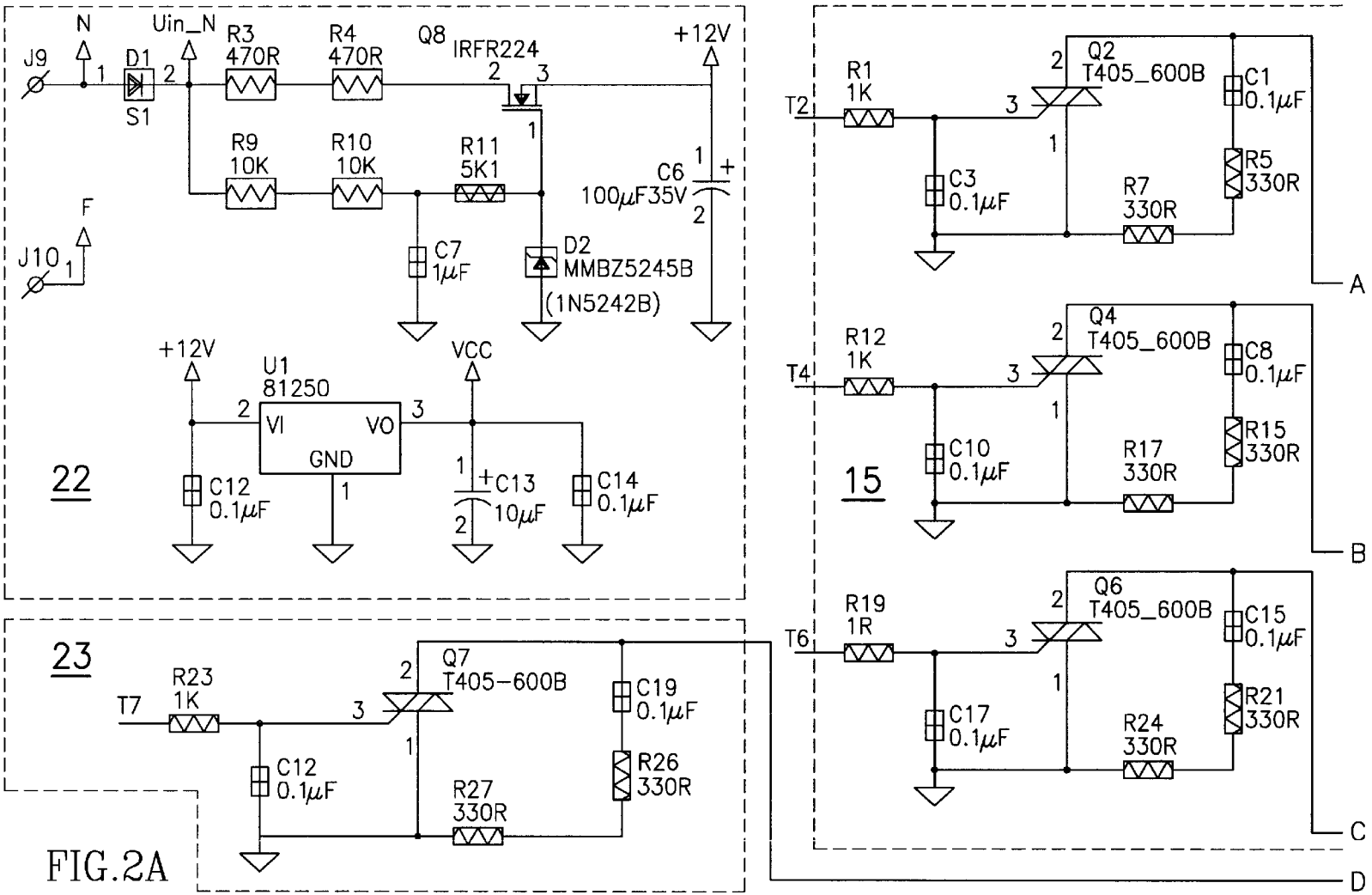
FIGS. 2A–2D are detailed electronic schematics of the magnetic/electronic metal halide ballast of the present invention.
Figure 2B:
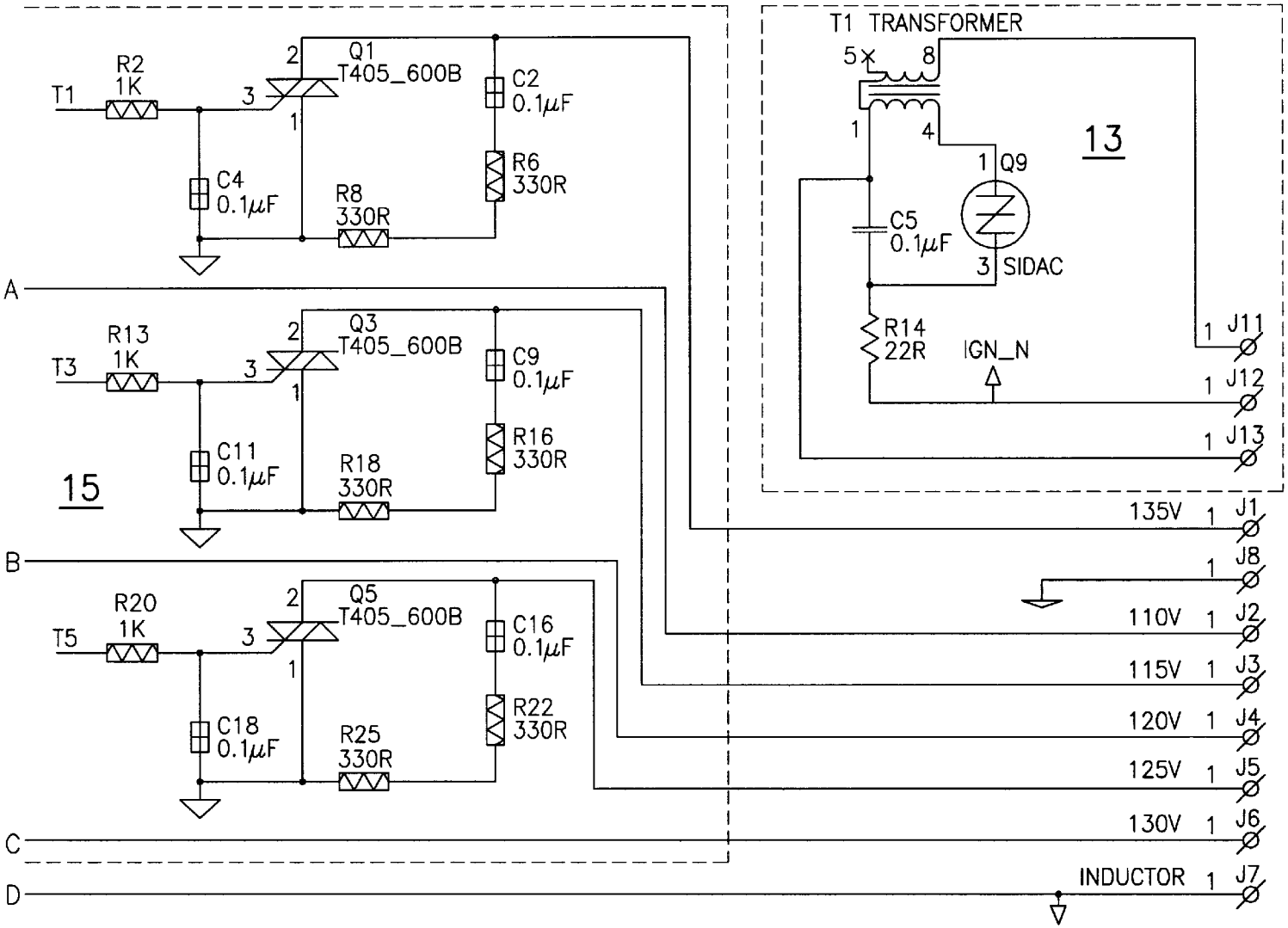
Figure 2C:
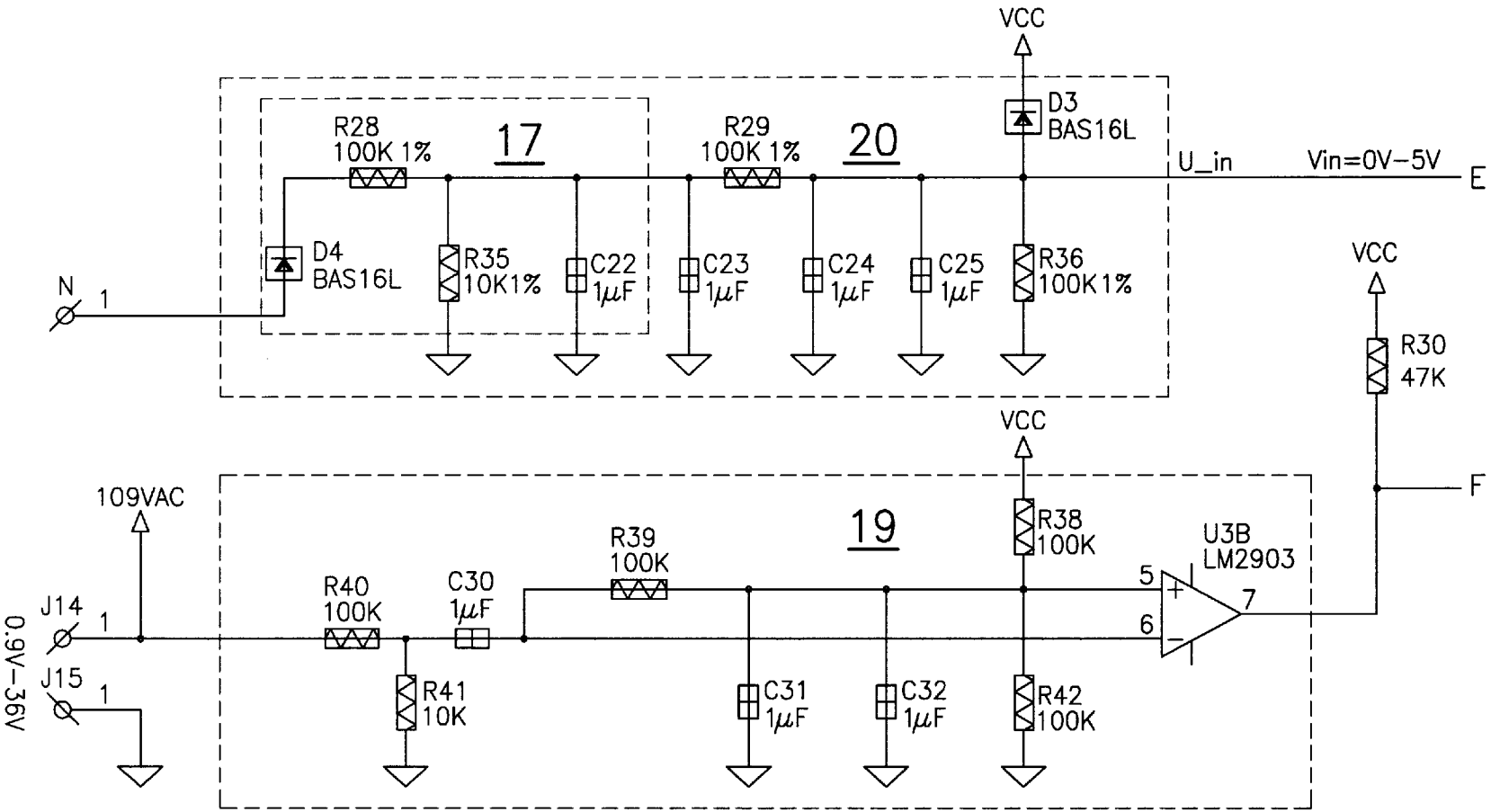
Figure 2D:
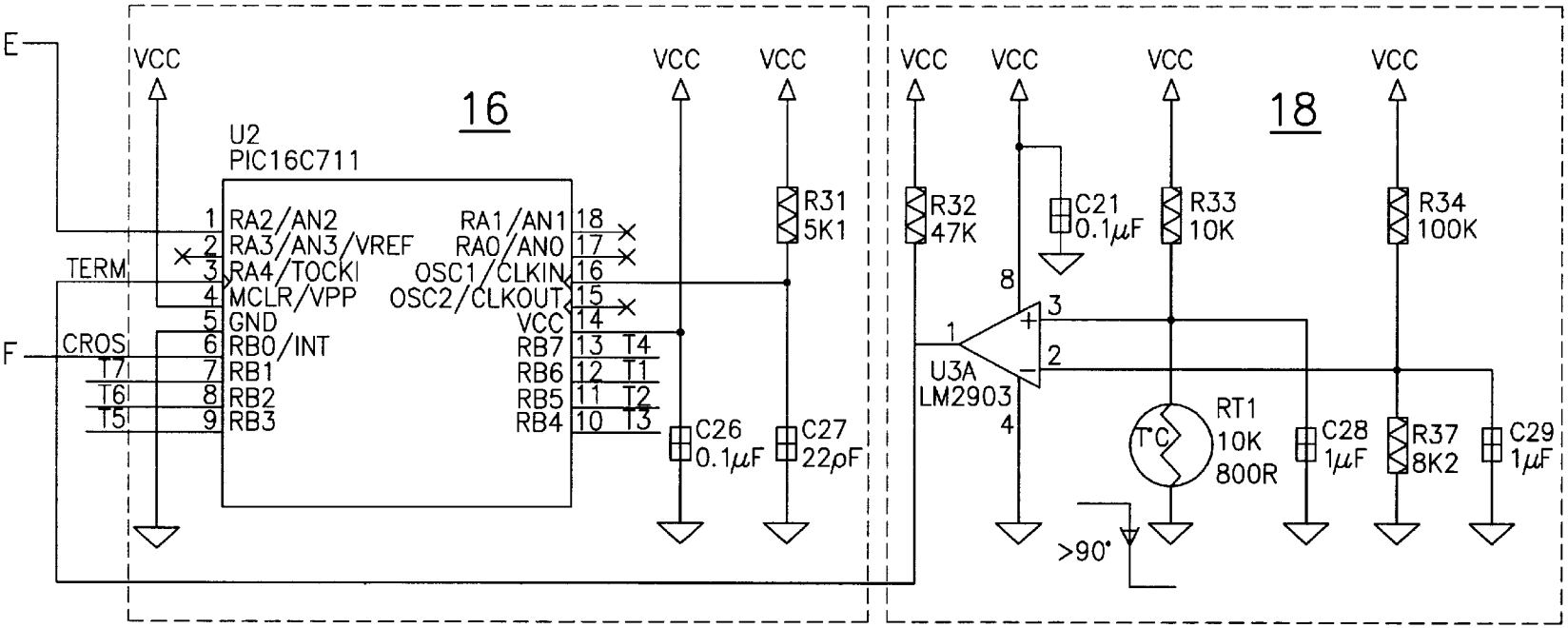

Referring now to FIG. 1, there is shown an electronic schematic of metal halide lamp magnetic ballast 10 with an electronic controller (magnetic/electronic ballast, herein referred to as MEB). The present invention provides a combination of the conventional core and coil approach and the electronic control approach. A metal halide lamp 11 is connected between the output of an igniter 13 and the common connection, to provide ignition voltage. The input of igniter 13 is connected to inductor 12, which is in turn connected to the output of an autotransformer $T_A$. A power factor correction capacitor C is also connected across the output of the autotransformer $T_A$ and together with input inductance 14 forms the configuration of a ferro-resonant Constant Voltage Transformer (CVT), wherein inductor 14 reduces Total Harmonic Distortion (THD). Metal halide ballast 10 constantly monitors the autotransformer input voltage, at point "A", using voltage sensor 17.

In accordance with the principles of the invention, the primary winding (input) of autotransformer $T_A$ is tapped and connected in a switching arrangement with triac switches 15. In this fashion, the lamp power can be controlled by switching of triac switches 15 in a step-wise fashion into a selected switching state. Triac switches 15 provide more reliable switching than the prior art techniques, are less expensive and do not generate RFI's, as the switching occurs at zero voltage and current level.

In the case where the line voltage or voltage on the lamp and/or the current in the lamp changes, the autotransformer $T_A$ input voltage changes too, and the switching of triac switches 15 will compensate and adjust for the change in the lamp power by selecting a tap of the autotranformer $T_A$. This compensation is provided by selecting from among a set of voltage steps, from 110V to 135V. As was stated above, capacitor C, autotransformer $T_A$ and input inductance 14 form the configuration of a ferro-resonant Constant Voltage Transformer (CVT). Because of resonance in the circuit and sensitivity of the CVT to changes of loading, autotransformer $T_A$ input voltage (at point "A"), can be either higher or lower than the line voltage, and depends on the impedance of the lamp 11. The autotransformer $T_A$ and inductor 12 are designed in such a manner that rated power on the lamp 11 will be achieved if the appropriate one of input taps of the autotransformer $T_A$ is switched by the triac corresponding to the voltage sensed at point "A".

Figure 3:
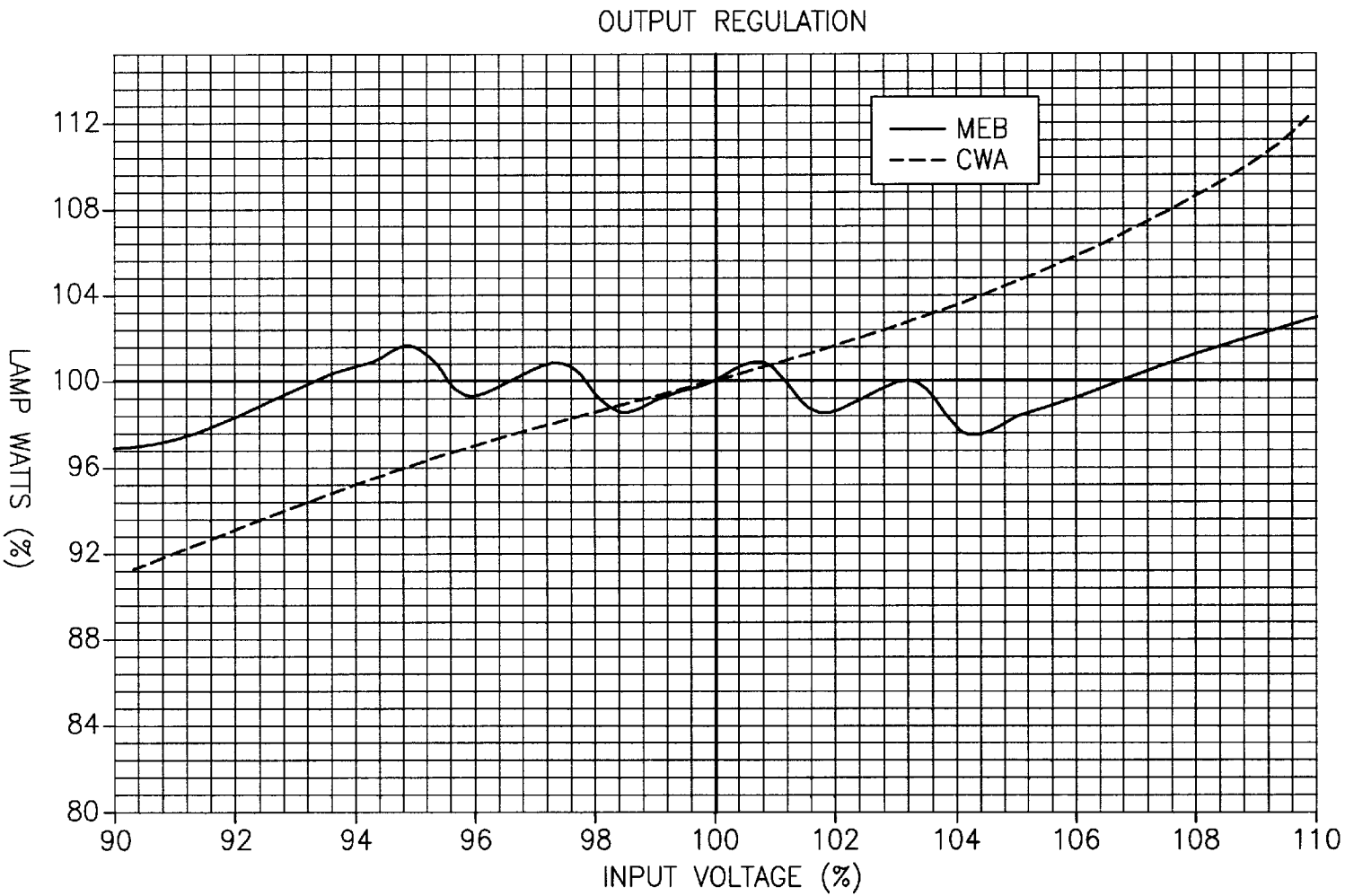
FIG. 3 is a comparative output regulation diagram showing the performance of the Constant Wattage Autotransformer (CWA) and the metal halide lamp magnetic/electronic ballast (MEB) of the present invention.

That is, for example, if the voltage at point "A" is measured at 115V, the triac switching input tap of 115V will be activated by triacs driver 16. Thus, triacs driver 16 measures the voltage at point "A", and activates that triac, which will connect the appropriate input tap of the autotransformer $T_A$. Within the range of one 5 volt step of input taps, the CVT provides regulation of 2%, when there is a change in the line voltage up to 4%, Thus, together with the switching of input autotransformer $T_A$ taps, the metal halide ballast 10 provides regulation of ±2%–3% of the lamp power for a change in line voltage of ±10% (see FIG. 3 comparison of MEB and CWA). Thus, the power factor (PF) reaches 0.987, and THD is no more than 6%–7%.

The triac switches 15 are controlled by triacs driver 16, which closes each triac when the voltage at point "A" passes through a zero level, and opens it, when the current passes through a zero level, with a delay to avoid a short circuit. The delay is less than 8 milliseconds. If the power interruption is greater than 8 milliseconds, lamp 11 is extinguished.

Detailed electronic schematics are shown in FIGS. 2A–2D. Microcontroller 16 controls triac switches 15. Voltage measurement circuitry 20 includes voltage sensor 17. Voltage measurement circuitry 20 also operates to disconnect all triacs in case of damage of a lamp or if there is no lamp. In case of an interruption of electricity when the lamp has not yet cooled down, triac driver 16 will attempt to ignite the lamp fifteen times for 5 seconds with a pause of 2 minutes between each attempt, to prevent destruction of electrodes from the high voltage of igniter 13.

The circuit 18 provides temperature protection and disconnects all triacs at an operating temperature in excess of 90° C. The circuit 19 generates cross pulses for activating each triac when the input voltage applied to autotransformer $T_A$ crosses the zero level. The circuit 23 includes triac Q7 which is intended to short circuit the inductor 14 (see FIG. 1) when the lamp is heated up, to allow reduction of the time of heating of the lamp because in this case, the lamp warms up at a current exceeding the nominal value by 1.5 times. The circuit 22 is the power supply for triacs driver 16, temperature protector circuit 18, pulse generator 19, and voltage measurement circuit 20.

Igniter 13 is a separate circuit for starting up the lamp and provides a high voltage pulse of 4.5 kilovolts with a one-microsecond pulse width. The high voltage source in igniter 13 is pulse transformer T1. Thus, the present invention provides an HID lamp ballast using a combination of the conventional and electronic prior art methods providing a step-wise compensation for adjusting the lamp power in a cost-efficient and reliable fashion without generating RFI effects.

Having described the invention with regard to certain specific embodiments thereof, it is to be understood that the description is not meant as a limitation, since further modifications may now suggest themselves to those skilled in the art, and it is intended to cover such modifications as fall within the scope of the appended claims.

We claim:

1. A magnetic/electronic ballast for an HID lamp comprising:

a variable output voltage supply connected across an inductor and the lamp, for applying thereto a selected output voltage;

a voltage sensor for measuring an input voltage to said voltage supply;

a controller responsive to said measured input voltage to provide a switching signal; and a switching arrangement connected to said voltage supply for selecting an appropriate switching state in accordance with said switching signal, wherein said switching state is provided in order to maintain a relatively constant power through said lamp throughout its useful life.

2. The electronic ballast of claim 1 claim wherein said voltage supply comprises an autotransformer arranged with a plurality of taps on its primary winding for providing said switching state using said switching arrangement.

3. The electronic ballast of claim 2 further comprising an igniter providing an ignition voltage to the lamp provided as a high voltage pulse.

4. The electronic ballast of claim 3 wherein said switching arrangement comprises a plurality of triac switches each connected at one of said taps, said switching arrangement further including a triac driver.

5. The electronic ballast of claim 4 wherein said triac driver is operable to repeatedly activate said igniter when power to the lamp has been interrupted and the lamp has not cooled down, said repeated activation being provided in intervals of approximately 5 seconds with pauses of 2 minutes therebetween.

6. The electronic ballast of claim 1 wherein said switching arrangement provides regulation of the lamp power in relation to said measured input voltage.

7. The electronic ballast of claim 1 wherein regulation of the lamp power enables a high power factor greater than 0.97.

8. The electronic ballast of claim 1 in which said selected output voltage has a total harmonic distortion of 6%–7%.

9. The electronic ballast of claim 1 further including circuitry for increasing the current to the lamp beyond a nominal value to decrease the lamp warmup time.

10. The electronic ballast of claim 1 wherein said switching arrangement provides said selected appropriate applied input voltage without generating RFI.

11. A method for operating a magnetic/electronic ballast for an HID lamp comprising:

providing a variable output voltage supply connected across an inductor and the lamp for applying thereto a selected output voltage;

measuring an input voltage to said voltage supply;

providing a switching signal in response to said measured input voltage; and selecting an appropriate switching state in accordance with said switching signal, wherein said switching state is provided in order to maintain a relatively constant power through said lamp throughout its useful life.

12. The method of claim 11 further comprising providing an igniter generating an ignition voltage to the lamp provided as a high voltage pulse, wherein said igniter is repeatedly activated when power to the lamp has been interrupted and the lamp has not cooled down, said repeated activation being provided in intervals of approximately 5 seconds with pauses of 2 minutes therebetween.

13. The method of claim 11 further comprising increasing the current to the lamp beyond a nominal value to decrease the lamp warmup time.

14. The method of claim 11 wherein said switching enables regulation of the lamp power in relation to said measured input voltage.

15. The method of claim 11 wherein said switching is provided without generating RFI.

* * * * *